US007793441B2

(12) United States Patent
Clymans

(10) Patent No.: US 7,793,441 B2
(45) Date of Patent: Sep. 14, 2010

(54) DEVICE AND METHOD FOR CHANGING A SUCTION MOUTH

(75) Inventor: Etienne Clymans, Tisselt (BE)

(73) Assignee: Dredging International N.V., Zwijndrecht (BE)

( * ) Notice: Subject to any disclaimer, the term of this patent is extended or adjusted under 35 U.S.C. 154(b) by 272 days.

(21) Appl. No.: 11/922,575

(22) PCT Filed: Jun. 16, 2006

(86) PCT No.: PCT/BE2006/000068

§ 371 (c)(1),
(2), (4) Date: May 5, 2008

(87) PCT Pub. No.: WO2007/014440

PCT Pub. Date: Feb. 8, 2007

(65) Prior Publication Data

US 2009/0113769 A1 May 7, 2009

(30) Foreign Application Priority Data

Jun. 23, 2005 (BE) ..... 2005/0320

(51) Int. Cl.
*E02F 9/10* (2006.01)

(52) U.S. Cl. ..... 37/334; 37/307

(58) Field of Classification Search ..... 37/307, 37/309, 312, 334, 317

See application file for complete search history.

(56) References Cited

U.S. PATENT DOCUMENTS

| | | | | |
|---|---|---|---|---|
| 503,732 | A * | 8/1893 | Bates | 37/330 |
| 2,762,136 | A * | 9/1956 | Bell | 37/326 |
| 3,171,219 | A * | 3/1965 | Kaufmann et al. | 37/313 |
| 3,446,366 | A | 5/1969 | Miller | |
| 4,010,560 | A * | 3/1977 | Diggs | 37/308 |
| 4,627,377 | A | 12/1986 | Zoonens | |
| 4,646,450 | A * | 3/1987 | Kurvers et al. | 37/336 |
| 2003/0192466 | A1 | 10/2003 | Trowbridge | |
| 2006/0236566 | A1 * | 10/2006 | Clymans | 37/343 |

FOREIGN PATENT DOCUMENTS

| | | |
|---|---|---|
| EP | 0153248 | 8/1985 |
| GB | 1410274 | 10/1975 |
| JP | 49-095398 | 9/1974 |
| JP | 51-027299 | 3/1976 |
| JP | 52-043296 | 4/1977 |
| SU | 1229131 | 5/1986 |
| WO | 93/07082 | 4/1993 |

* cited by examiner

*Primary Examiner*—Robert E Pezzuto
*Assistant Examiner*—Jamie L McGowan
(74) *Attorney, Agent, or Firm*—Harness, Dickey & Pierce, P.L.C.

(57) ABSTRACT

A device is disclosed for changing a suction mouth of a cutter suction dredge of a vessel with cutter ladder. In at least one embodiment, the device includes, comprising a work platform which, as seen in the transverse direction of the vessel, is provided substantially in the middle with an opening, wherein—a support structure is provided which can be fixedly connected to the work platform in a position substantially under the opening, which support structure is adapted to support a suction mouth;—and the work platform with support structure is tiltable around a first, substantially horizontal transverse axis between a substantially horizontal operating position and a high position in which the cutter ladder can be moved upward, which positions are such that the work platform with support structure is movable from its high position to its operating position when the cutter ladder is situated in a high raised position.

20 Claims, 6 Drawing Sheets

Figure 3A:
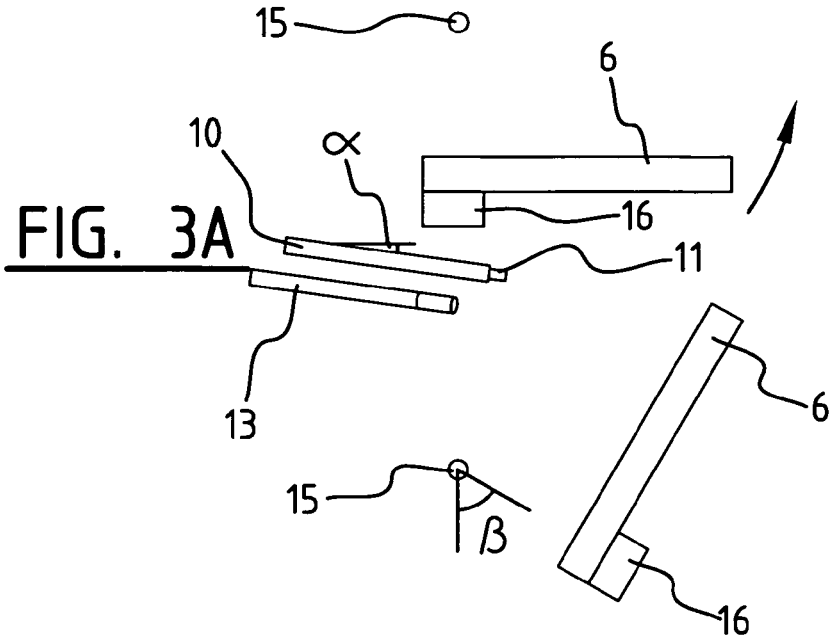

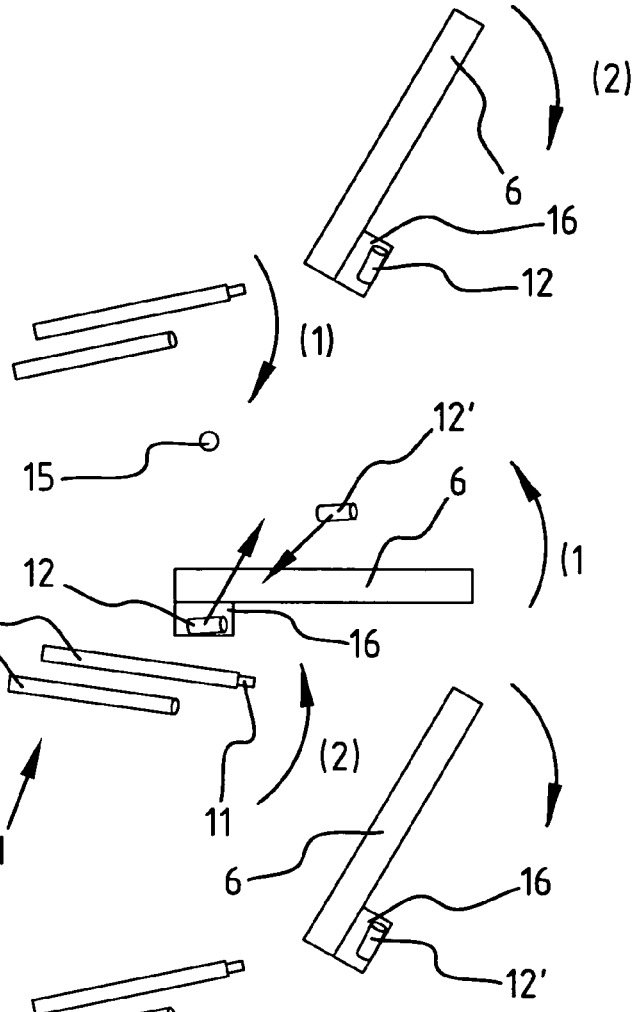
FIG. 3F
FIG. 3G
FIG. 3H
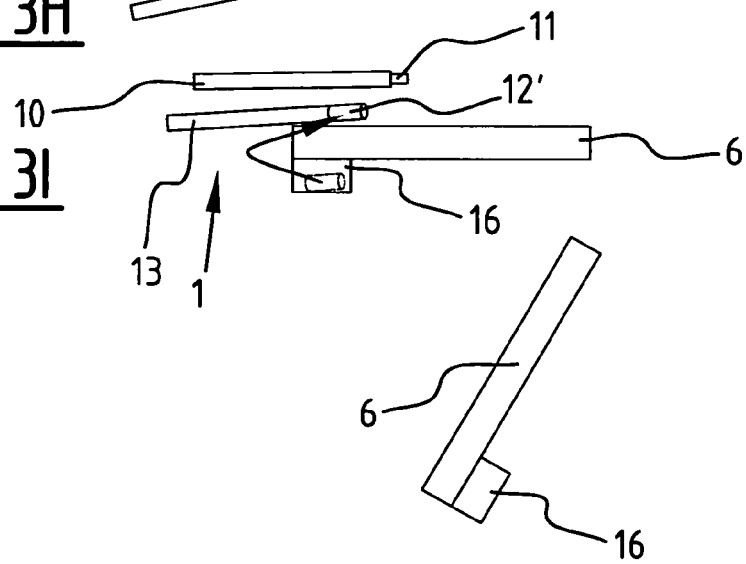
FIG. 3I
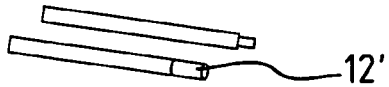
FIG. 3J

DEVICE AND METHOD FOR CHANGING A SUCTION MOUTH

The present invention relates to a device and method for changing a suction mouth of a cutter suction dredge of a dredging vessel with cutter ladder, comprising a work platform which, as seen in the transverse direction of the vessel, is provided substantially in the middle with an opening. The invention also relates to a method for replacing a first suction mouth connected to a cutter suction dredge with a second suction mouth.

It is known to provide a work platform, often also referred to as cutter platform, on a vessel with cutter suction dredge so that the cutter head, which is subject to wear, can be exchanged on a regular basis. A suction mouth on the other hand is a component which for most types of cutter suction dredge does not have to be replaced, or rarely so. In a new type of cutter suction dredge as described in the international application WO 2004/1113535 in the name of applicant a number of suction mouths with differing entry section can however be connected to the suction pipe, wherein the entry section is determined by the nature of the dredged material to be removed. For a material such as sand or gravel a suction mouth will be connected which has an entry section which is larger than that which would be connected in order to dredge for instance rock. For optimum efficiency of such a system it is thus necessary to change suction mouth each time a transition is made from rock and stone to soil, so that the device can be optimally productive and competitive in both fields of application.

The present invention has for its object to provide a device and method of the type stated in the preamble with which a suction mouth can be exchanged in an efficient manner.

For this purpose the device according to the invention is distinguished in that:

- a support structure is provided which can be fixedly connected to the work platform in a position substantially under the opening, which support structure is adapted to support a suction mouth at a level substantially below the work platform;
- the work platform with support structure is tiltable around a substantially horizontal transverse axis between a substantially horizontal operating position and a high position in which the cutter ladder can be moved upward, which positions are such that the work platform with support structure is movable from its high position to its operating position when the cutter ladder is situated in a high raised position, typically also in the case a suction mouth is fixed onto the support structure.

As seen in a longitudinal section, the suction mouth lies under the drive shaft of the cutter head and offset over a longitudinal distance relative to the cutter head. In order to make the work platform, which is normally intended for change of the cutter head, also suitable for changing the suction mouth, a support structure is provided in the central opening of the work platform such that the support structure is movable to a position under the suction mouth. As will be further elucidated in detail, the method according to the invention can be performed in that the work platform with support structure is tiltable between an operating position and a high position while the cutter ladder is situated in a high position.

According to a preferred embodiment, the support structure comprises a bottom and two longitudinal walls which are connected to the work platform close to respective longitudinal edges of the opening in the work platform. In view of the weight of the suction mouth, the support structure is preferably provided with a horizontal steel frame which can bear the weight of the suction mouth. In a particularly advantageous embodiment variant the support structure is a flat rack.

In a typical embodiment of the device according to the invention the work platform is also tiltable around a second, substantially horizontal transverse axis for raising the platform so that it is sufficiently far removed from the surface of the sea, if the vessel is for instance making a sea journey or if it is lying at anchor in turbulent water. Possible changing of the cutter head is hereby also made easier. This second transverse axis is preferably located behind the first transverse axis as seen in longitudinal direction of the vessel.

According to a possible variant, positioning means are provided on the support structure for the purpose of positioning a suction mouth which is placed on the support structure and which must be connected to a suction pipe connected to the cutter ladder. Jack means can for instance thus be provided for the vertical and horizontal positioning of the suction mouth. Chain pulleys can further also be provided, for instance for positioning in athwartship direction.

The invention further relates to a method for replacing a first suction mouth connected to a suction pipe by a second suction mouth, and is distinguished in that:

- the work platform is carried into a high position;
- the cutter ladder is carried into a high position, wherein the cutter axis preferably inclines slightly upward relative to the horizontal;
- the work platform is carried into a substantially horizontal operating position under the first suction mouth;
- the first suction mouth is arranged on the support structure and uncoupled from the cutter ladder;
- the first suction mouth is removed from the support structure; this preferably taking place as follows:
  - the first suction mouth is connected fixedly to the support structure;
  - the work platform with first suction mouth is carried into the high position;
  - the cutter ladder is carried into a low position;
  - the work platform with first suction mouth is carried into a substantially horizontal operating position;
  - the first suction mouth is removed using lifting means present on the dredging vessel;
- a second suction mouth is placed on the support structure;
- the second suction mouth is arranged on the cutter ladder; this preferably taking place as follows:
  - the work platform is carried into a high position;
  - the cutter ladder is carried into a high position;
  - the work platform is carried into the substantially horizontal operating position;
  - the cutter ladder is allowed a little slack, preferably until the cutter axis is practically horizontal;
  - the suction mouth is coupled to the cutter ladder.

The work platform is thus used as auxiliary means for changing a suction mouth, without means from outside the vessel being necessary for this purpose.

The arranging of the first suction mouth on the support structure preferably takes place by lowering the cutter ladder until the suction mouth rests on the support structure. The suction mouth can then be pressed up, for instance by means of jacks, and detached from the cutter ladder and the suction pipe. By retracting the jacks the suction mouth is lowered onto a seat disposed for this purpose on the support structure.

After being placed on the support structure, the second suction mouth must further be positioned precisely relative to the suction pipe to which it must be connected. According to a possible variant, this positioning can take place by lifting or lowering the cutter ladder and/or the work platform. According to another variant, this positioning takes place using jack means and/or chain pulleys.

Figure 1:
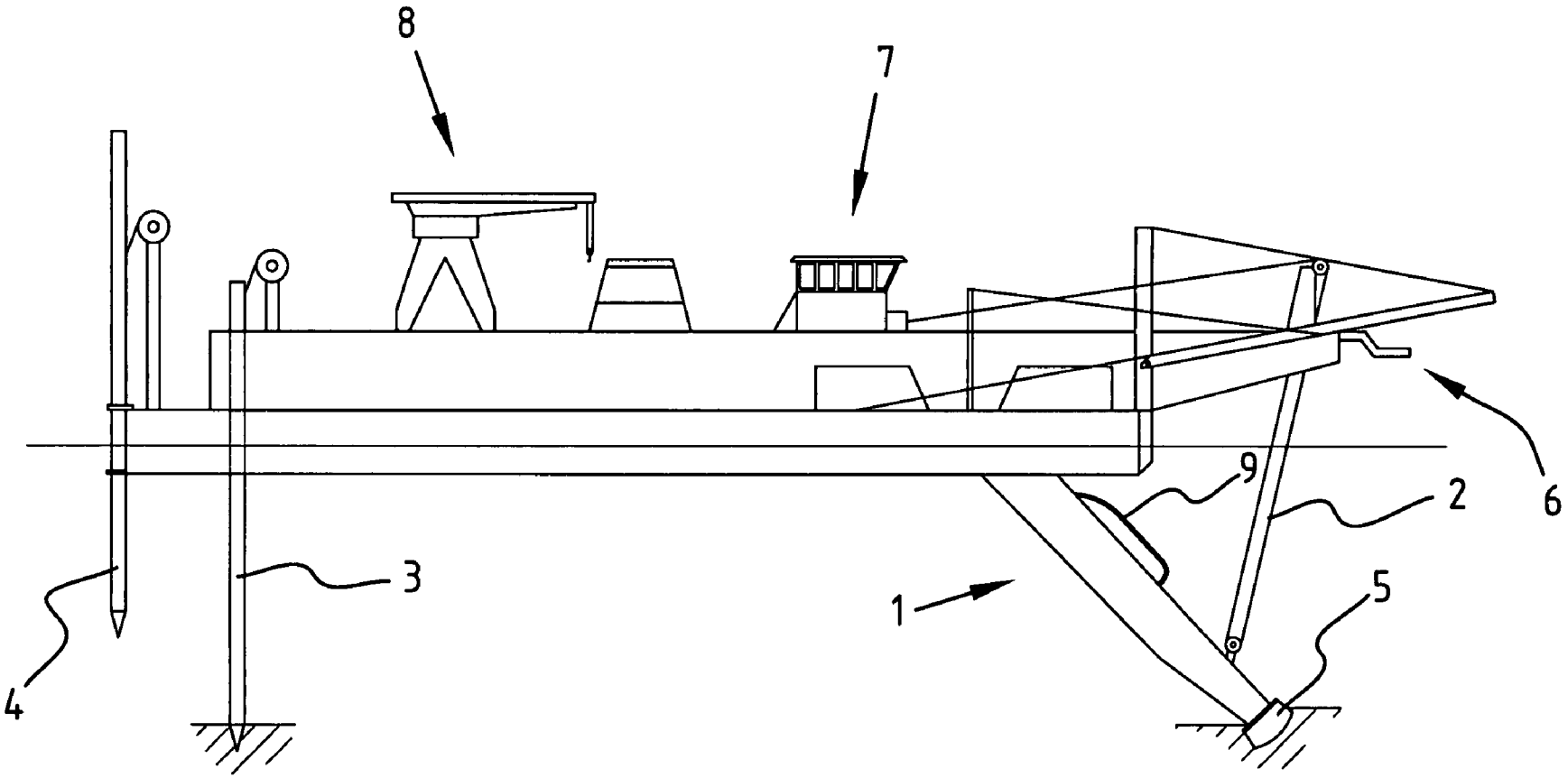
Figure 2A:
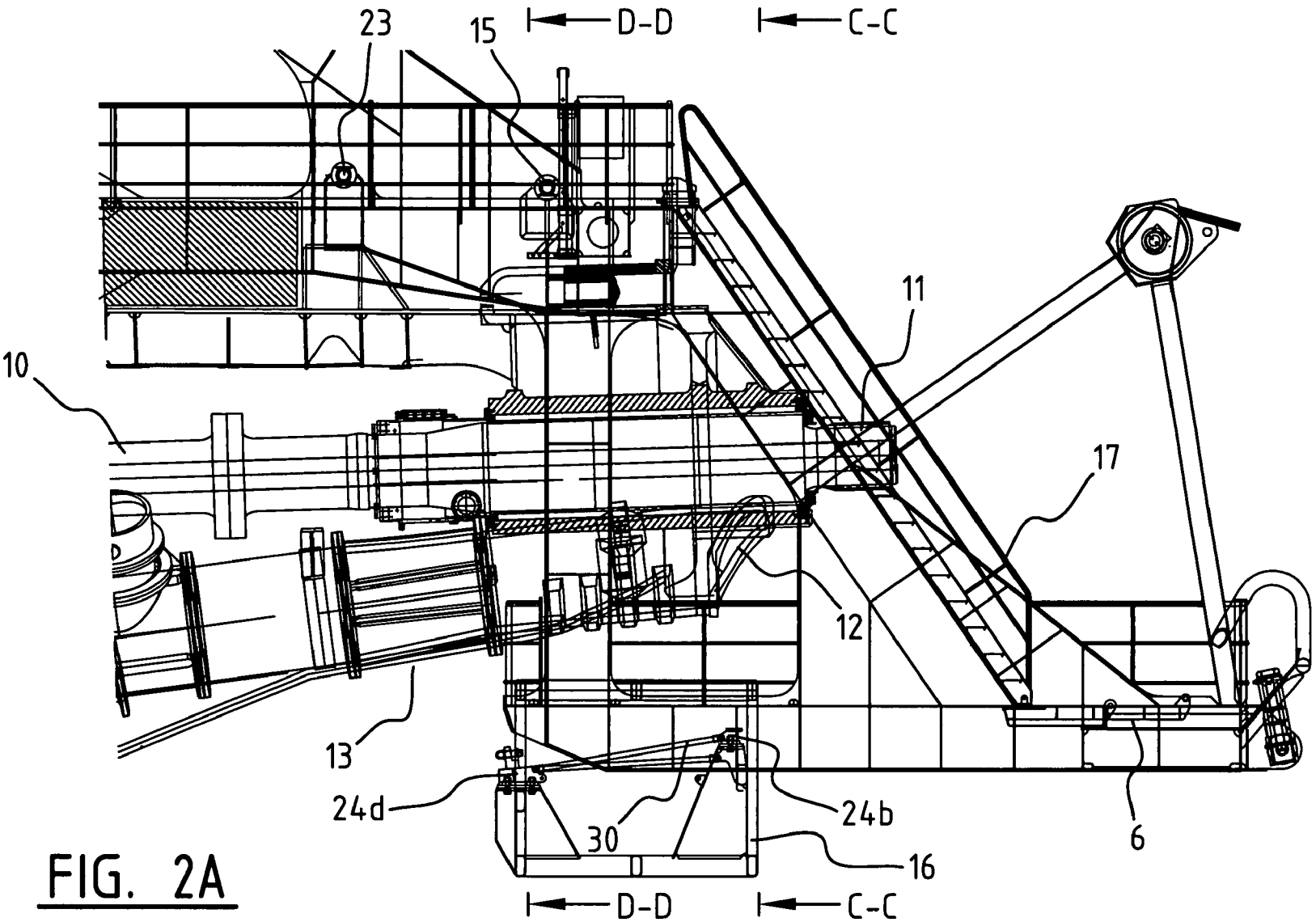

The present invention will be further elucidated on the basis of a number of non-limitative exemplary embodiments with reference to the accompanying drawing, in which:

FIG. 1 shows a side view of a vessel with cutter suction dredge;

FIGS. 2(A), (B), (C) and (D) show respectively a longitudinal view, a top view, a transverse view along C-C and a transverse view along D-D of an embodiment of the device according to the invention, with the work platform in the low operating position and the cutter ladder in the high position;

FIGS. 3(A)-(J) illustrate schematically an embodiment of the method according to the invention.

FIG. 1 shows an embodiment of a vessel with cutter suction dredge. The typical components of such a vessel are a cutter ladder 1 with ladder hoisting cable 2, and two anchor or spud posts 3, 4. Situated on the outer end of the ladder is a cutter head 5, and provided along the ladder are suction means 9 which comprise a suction mouth, suction pipe and a pump. The ship is further provided with a deck crane 8 for all kinds of operations on deck, a bridge 7 and a work platform 6, for instance for performing maintenance operations on cutter head 5, or for changing the suction mouth. This work platform will be further described with reference to FIGS. 2(A)-2(D) which show an embodiment of the device according to the invention.

Figure 2B:
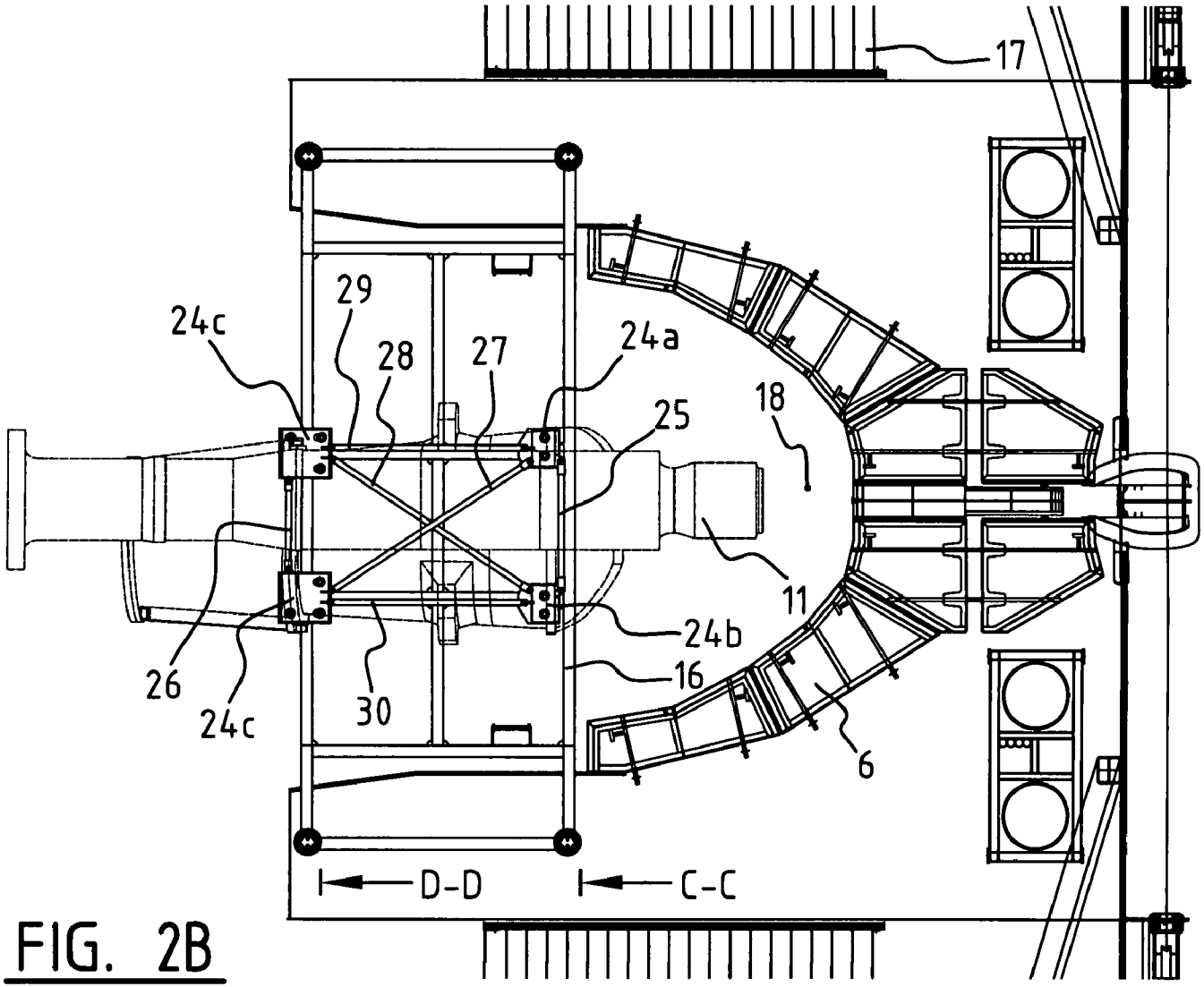
Figure 2C:
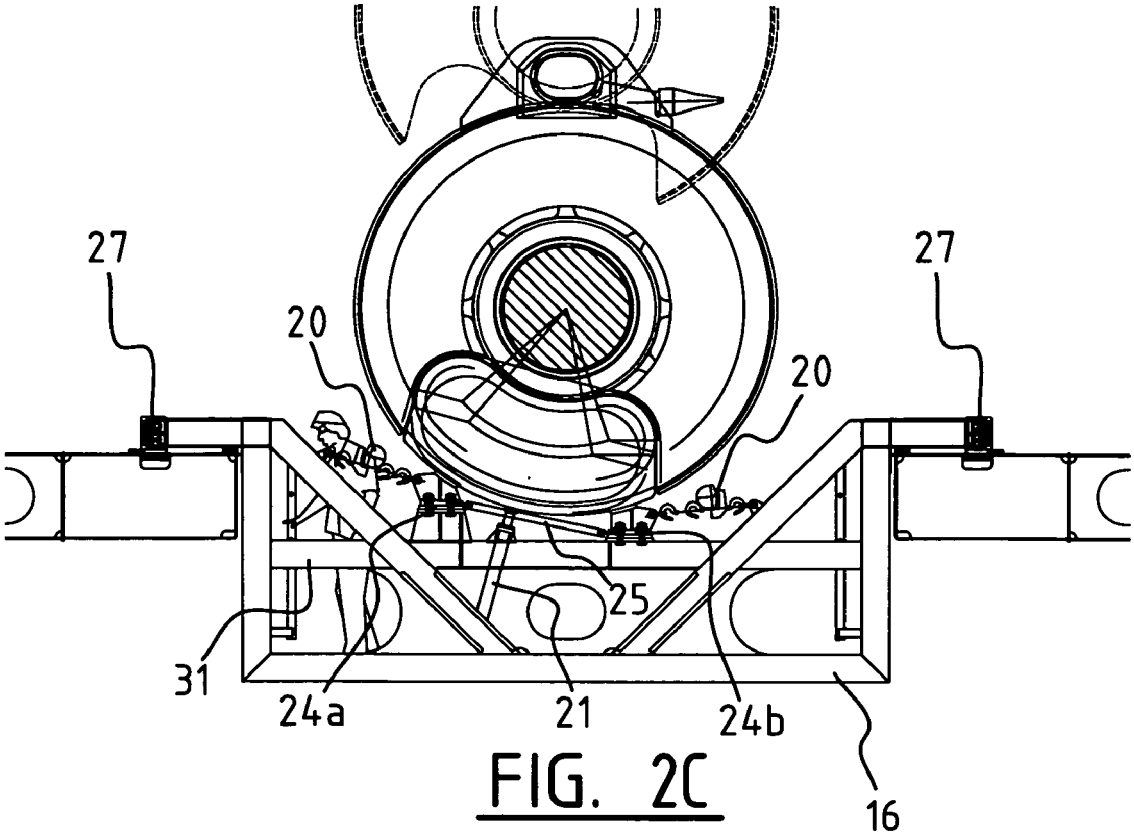
Figure 2D:
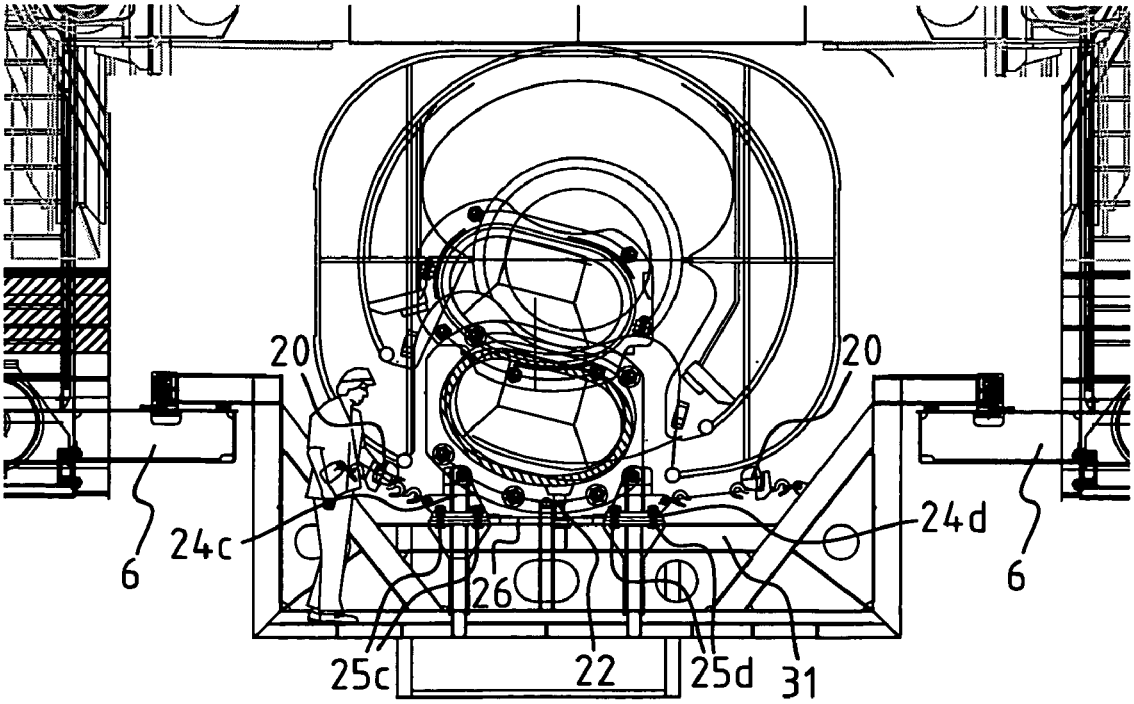

The embodiment shown in FIG. 2 comprises a work platform 6 which, as seen in the transverse direction (see FIG. 2(B)), is provided with a central opening 18. Provided in this central opening 18 is a support structure, here a flat rack 16, which has two longitudinal walls 26 which are connected by means of connecting means 27, 28 to work platform 6. Work platform 6 is tiltable around a first, substantially horizontal transverse axis 23 for the purpose of folding the work platform sufficiently far upward, for instance during sailing, and around a second, substantially horizontal transverse axis 15 located further forward for the purpose of exchanging the suction mouth.

The flat rack is further equipped with two vertical hydraulic jacks, a first hydraulic jack 21 for the front side of the suction mouth and a second hydraulic jack 22 for the flange side of the suction mouth. A horizontal hydraulic jack (not shown) is also provided for positioning of the suction mouth in alongship direction. Finally, chain pulleys 20 are provided for athwartship positioning of the suction mouth.

Provided in the flat rack is a so-called seat on which the suction mouth is placed. This seat comprises four legs 24*a*-24*d* with respective upper surfaces which are adapted to the shape of the suction mouth. These legs are provided with horizontal flanges which are connected by means of nut-bolt connections 25*a*-25*d* to a support platform 31 in flat rack 16. The openings in the flanges for bolts 25*a*-25*d* have a larger diameter than that of the bolts, so that the bolts are received with some clearance in the openings and the legs can be moved to a limited extent in the horizontal plane when the nuts are not tightened. By providing six rods, i.e. two transverse rods 25-26, two diagonal rods 27-28 and two longitudinal rods 29-30 which mutually connect the legs 24*a*-24*d*, the seat forms a rigid whole which has limited movement relative to support platform 31. This movement can for instance take place in the longitudinal direction using the horizontal jack, and in athwartship direction using the chain pulleys, as will be further elucidated.

An embodiment for exchanging the suction mouth according to the invention will now be explained step-by-step with reference to FIG. 3. Work platform 6 is first brought into its substantially horizontal, low position and cutter ladder 1 is brought into a low position under the work platform, for instance at an angle which is greater than about 5°, preferably greater than 8° relative to the horizontal (FIG. 3(A)). Flat rack 16 is placed in the central opening of the cutter platform and secured with for instance conventional container locking means.

Figure 3B:
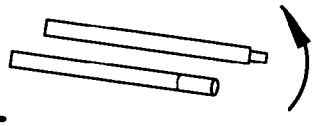
Figure 3C:
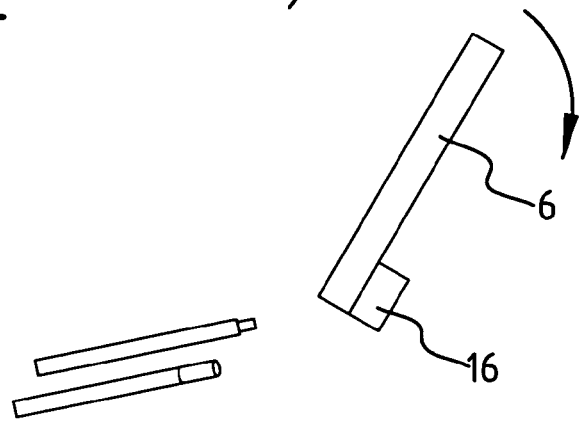
Figure 3D:
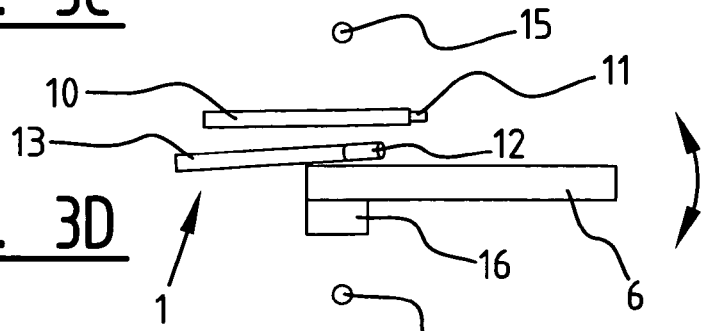
Figure 3E:
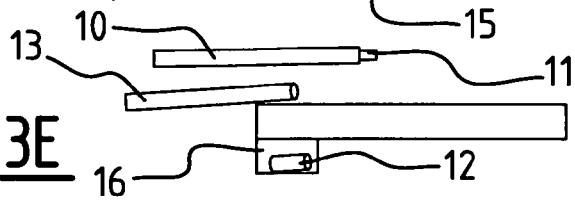

Work platform 6 with flat rack 16 fixed therein is carried into a high position by tilting around a horizontal transverse axis 15, for instance through an angle lying between about 60° and 80° (FIG. 3(B)). The cutter ladder is brought into the highest position, for instance between about −1 and −5° relative to the horizontal, whereafter work platform 6 can be returned to the low, substantially horizontal position, wherein suction mouth 12 is situated above work platform 6 (FIGS. 3© and (D)).

The cutter ladder is then lowered until suction mouth 12 is almost supported by flat rack 16, whereafter the suction mouth will be pressed up by two jacks 21, 22, which support on the seat of the flat rack, so that it can be uncoupled from the cutter ladder, whereafter the jacks are retracted and the suction mouth rests on the seat. The cutter ladder is then returned to the highest position and the suction mouth is secured to the seat on the flat rack such that the work platform can be tilted back to its high position (FIGS. 3(E) and (F)).

The cutter ladder is now lowered back to its low position, and the work platform is subsequently carried back into the low position (FIGS. 3(F) and (G)). In this position the cutter ladder is not in the way and the suction mouth can be exchanged for another suction mouth using for instance the deck crane 8.

After placing thereof, the other suction mouth 12' must be secured to the seat on the flat rack so that first the work platform and then the cutter ladder can be carried into their highest position (FIG. 3(H)), whereafter the work platform is carried into its low, substantially horizontal operating position (FIG. 3(I)).

The new suction mouth 12' can now be uncoupled from the flat rack, whereafter the cutter ladder is lowered until the suction mouth is located substantially in front of the suction pipe such that the new suction mouth can be mounted on the suction pipe. The positioning of the suction mouth relative to the cutter ladder can take place in different ways, as will be set forth in further detail. Once the new suction mouth has been connected to the suction pipe, the cutter ladder can be moved back to the highest position. Finally, the work platform is moved back to the high position, and the ladder with new suction mouth is ready for use (FIG. 3(J)).

A correct vertical, athwartship and alongship positioning of the suction mouth relative to the suction pipe can take place in different ways.

According to a first option, the vertical positioning of the suction mouth can take place by moving the ladder upward/downward. According to another option, the substantially vertical jack means 21, 22 between suction mouth and flat rack are used. A combination of these options is of course also possible.

The athwartship positioning typically takes place using the chain pulleys 20.

The alongship positioning can for instance be carried out by horizontal jack means or by moving the work platform upward (and therefore also forward) using the winches of the work platform.

The invention is not limited to the above illustrated embodiment, and a skilled person will appreciate that other means or methods can for instance be provided for the positioning relative to the cutter ladder. The scope of the invention includes all these variants and is defined solely by the following claims.

The invention claimed is:

1. Device for changing a suction mouth of a cutter suction dredge of a vessel with cutter ladder, comprising:

a work platform which, as seen in a transverse direction of the vessel, is provided substantially in a middle with an opening; and a support structure fixedly connectable to the work platform in a position substantially under the opening, the support structure being adapted to support a suction mouth, the work platform and the support structure being tiltable around a first, substantially horizontal transverse axis between a substantially horizontal operating position and a relatively high position in which the cutter ladder is movable upward, the positions being such that the work platform with support structure is movable from the relatively high position to the operating position when the cutter ladder is situated in a relatively high raised position.

2. Device as claimed in claim 1, wherein the support structure comprises a bottom and two longitudinal walls, which longitudinal walls are connected to the work platform close to respective longitudinal edges of the opening therein.

3. Device as claimed in claim 1, wherein the support structure comprises a horizontal steel frame which can support the suction mouth.

4. Device as claimed in claim 1, wherein the support structure is a flat rack.

5. Device as claimed in claim 1, wherein the support structure is provided with a receiving structure with a design adapted to that of the suction mouth, the receiving structure being movable to a limited extent relative to the support structure.

6. Device as claimed in claim 5, wherein the receiving structure comprises at least four legs rigidly connected to each other.

7. Device as claimed in claim 5, wherein the receiving structure is connected to the support structure by bolts protruding with limited clearance into openings of the support structure.

8. Device as claimed in claim 1, wherein the work platform is tiltable around a second, substantially horizontal transverse axis for raising the platform to be sufficiently far removed from the surface of the sea, the second transverse axis being located behind the first transverse axis as seen in longitudinal direction of the vessel.

9. Device as claimed in claim 1, further comprising a positioning device for positioning relative to the cutter ladder a suction mouth resting on the support structure.

10. Device as claimed in claim 9, wherein the positioning device includes at least one jack.

11. Device as claimed in claim 9, wherein the positioning device includes at least one chain pulley.

12. Device as claimed in claim 1, wherein a second transverse axis being located behind the first transverse axis as seen in longitudinal direction of the vessel.

13. Method for replacing a first suction mount of a cutter suction dredge connected to a suction pipe by a second suction mouth, which dredging vessel includes a work platform which is provided substantially in the middle with an opening and with a support structure connected fixedly thereto in a position substantially under the opening comprising:

carrying the work platform into a relatively high position;

carrying the cutter ladder into a relatively high position;

carrying the work platform into a substantially horizontal operating position under the first suction mouth;

arranging the first suction mouth on the support structure and uncoupled from the cutter ladder;

removing the first suction mouth from the support structure;

placing a second suction mouth on the support structure; and arranging the second suction mouth on the cutter ladder.

14. Method as claimed in claim 13, wherein placing of the second suction mouth on the cutter ladder takes place as follows:

the work platform is carried into a relatively high position;

the cutter ladder is carried into a relatively high position;

the work platform is carried into the substantially horizontal operating position;

the cutter ladder is allowed a little slack, preferably until the cutter axis is practically horizontal; and the suction mouth is coupled to the cutter ladder.

15. Method as claimed in claim 13, wherein arranging of the first suction mouth on the support structure takes place by allowing the cutter ladder slack to an almost horizontal position.

16. Method as claimed in claim 13, wherein removal of the first suction mouth from the support structure takes place as follows:

the first suction mouth is connected fixedly to the support structure;

the work platform with first suction mouth is carried into the relatively high position;

the cutter ladder is carried into a relatively low position;

the work platform with first suction mouth is carried into a substantially horizontal operating position; and the first suction mouth is removed using lifting means present on the dredging vessel.

17. Method as claimed in claim 16, wherein, after being placed on the support structure, the second suction mouth is positioned for connection to the cutter ladder.

18. Method as claimed in claim 17, wherein the positioning takes place by raising or lowering at least one of the cutter ladder and the work platform.

19. Method as claimed in claim 17, wherein the positioning takes place with at least one of at least one jack and at least one chain pulleys.

20. Method as claimed in claim 18, wherein the positioning takes place with at least one of at least one jack and at least one chain pulley.

* * * * *